US005513551A

United States Patent [19]

Morishita

[11] Patent Number: 5,513,551

[45] Date of Patent: May 7, 1996

[54] HYDRAULIC CONTROL SYSTEM

[75] Inventor: Yutaro Morishita, Sakai, Japan

[73] Assignee: Kubota Corporation, Osaka, Japan

[21] Appl. No.: 274,272

[22] Filed: Jul. 13, 1994

[30] Foreign Application Priority Data

Sep. 3, 1993 [JP] Japan ..... 5-219914

[51] Int. Cl.[6] ..... F15B 13/044

[52] U.S. Cl. ..... 91/459

[58] Field of Search ..... 91/459

[56] References Cited

U.S. PATENT DOCUMENTS

| | | | |
|---|---|---|---|
| 4,358,989 | 11/1982 | Tordenmaim | 91/361 |
| 4,744,218 | 5/1988 | Edwards et al. | 91/361 |
| 4,852,657 | 8/1989 | Hardy et al. | 91/459 |
| 5,046,312 | 9/1991 | Tsuda et al. . | |

FOREIGN PATENT DOCUMENTS

| | | |
|---|---|---|
| 0114401 | 1/1984 | European Pat. Off. . |
| 0189190 | 7/1986 | European Pat. Off. . |
| 411398 | 2/1991 | European Pat. Off. . |
| 534332 | 3/1992 | European Pat. Off. . |
| 2-256901 | 10/1990 | Japan . |
| 2154523 | 8/1985 | United Kingdom . |
| 2188892 | 10/1987 | United Kingdom . |
| 2225127 | 5/1990 | United Kingdom . |
| 2251587 | 7/1992 | United Kingdom . |

*Primary Examiner*—F. Daniel Lopez
*Attorney, Agent, or Firm*—Fisher & Associates

[57] ABSTRACT

A control system for controlling a flow control valve to drive a hydraulic actuator in response to operation of a control device. This system includes a position detecting sensor for detecting a shift position of the control device, a speed detecting unit for detecting a shifting speed of the control device, and a controller for generating a control signal to control the flow control valve based on the shift position and shifting speed of the control device, and outputting this control signal to the flow control valve. The controller includes a first signal computing unit for determining a first control signal value based on a shift of the control device, a second control signal computing unit for determining a second control signal value based on lapse of time from start of the shift of the control device and the shifting speed of the control device, and a comparing unit for comparing the first control signal value and the second control signal value and selecting the value providing the smaller opening amount of the flow control valve to act as the control signal. The control signal generated is such that the lower the shifting speed is, the smaller amount the flow control valve is opened, whereby the slower the control device is shifted, the slower the hydraulic actuator is operated.

3 Claims, 9 Drawing Sheets

HYDRAULIC CONTROL SYSTEM

BACKGROUND OF THE INVENTION

1. FIELD OF THE INVENTION

The present invention relates to a hydraulic control system for controlling a flow control valve to drive a hydraulic actuator in response to operation of a manual control device (such as a control lever or control pedal).

2. DESCRIPTION OF THE RELATED ART

The hydraulic control system noted above includes a position sensor for detecting shift positions of the manual control device. The flow control valve is operable to a position corresponding to a shift position of the manual control device detected by the sensor.

According to this control system, when the manual control device lies in a neutral stop position, the control valve is also placed in a neutral position to maintain the hydraulic actuator in a standstill state. As the manual control device is shifted from the neutral stop position to an operative position, the control valve is opened by an amount corresponding to the position of the control device, such that pressure oil is delivered at the higher flow rate from the control valve, the greater the amount of operation of the control device.

Thus, the hydraulic actuator is operable at the higher rate, the greater amount the control lever is operated from the neutral stop position. By selecting a shift position of the manual control device, the hydraulic actuator may be driven at a desired speed. That is, the shift position of the manual control device and the opening amount of the control valve are in a one-to-one relationship.

Thus, when it is desired to slightly move a working implement standing still, the manual control device must be shifted from the neutral stop position slightly to an operative position. This opens the control valve slightly, which in turn operates the hydraulic actuator slightly.

In practice, however, it is difficult for the operator to shift the manual control device from the neutral stop position to an operative position by a precise, slight amount. The manual control device is, more often than not, shifted from the neutral stop position to excess. Thus, slightly moving the working implement standing still requires a difficult operation.

SUMMARY OF THE INVENTION

The object of the present invention is to provide a hydraulic control system which enables a smooth control for slightly operating a hydraulic actuator standing still.

The above object is fulfilled, according to the present invention, by a hydraulic control system comprising:

- position detecting means for detecting a shift position of the control device;
- speed detecting means for detecting a shifting speed of the control device;
- control signal generating means for generating a control signal to control the flow control valve based on the shift position and the shifting speed of the control device; and
- control signal output means for outputting the control signal to the flow control valve.

This hydraulic system uses a difference between a slow operation and a fast operation of the control device, i.e. a shifting speed of the control device, as a parameter for controlling the flow control valve. Thus, the shifting speed of the control device is joined with movement of the flow control valve, hence movement of the hydraulic actuator. For example, the lower the shifting speed of the control device is, the smaller amount the flow control valve is opened. This is convenient when the hydraulic actuator is slightly operated for slightly moving a working implement standing still. When, for example, the control device is slowly shifted right or left from a neutral stop position, the flow control valve receives a control signal that opens the control valve by a smaller amount than when the control device is shifted fast. As a result, the hydraulic actuator tends to move slowly. This facilitates movement of the hydraulic actuator to a desired position.

Conversely, when it is desired to move the hydraulic actuator standing still to a different position quickly, the control device is shifted rapidly from the neutral stop position to a position corresponding to the different position. Since, in this case, the hydraulic actuator is operable following the shift of the control device, a quick control is realized though stopping precision may be somewhat low.

Thus, with the hydraulic control system according to the present invention, the hydraulic actuator may be started to operate slowly, with a limited opening amount of the control valve, by slowly shifting the manual control device from the neutral stop position to a certain high speed position without taking special care. This control system dispenses with the need for the operator to shift the control device slightly from the neutral stop position, with great care, as in the prior art, in order to start the hydraulic actuator slowly.

The operation is now carded out with increased facility to slightly move a working implement standing still. The hydraulic actuator is given improved operability.

Other features and advantages of the present invention will be apparent from the following description of a preferred embodiment of the invention taken in conjunction with the accompanying drawings.

DETAILED DESCRIPTION OF THE PREFERRED EMBODIMENT

Figure 1:
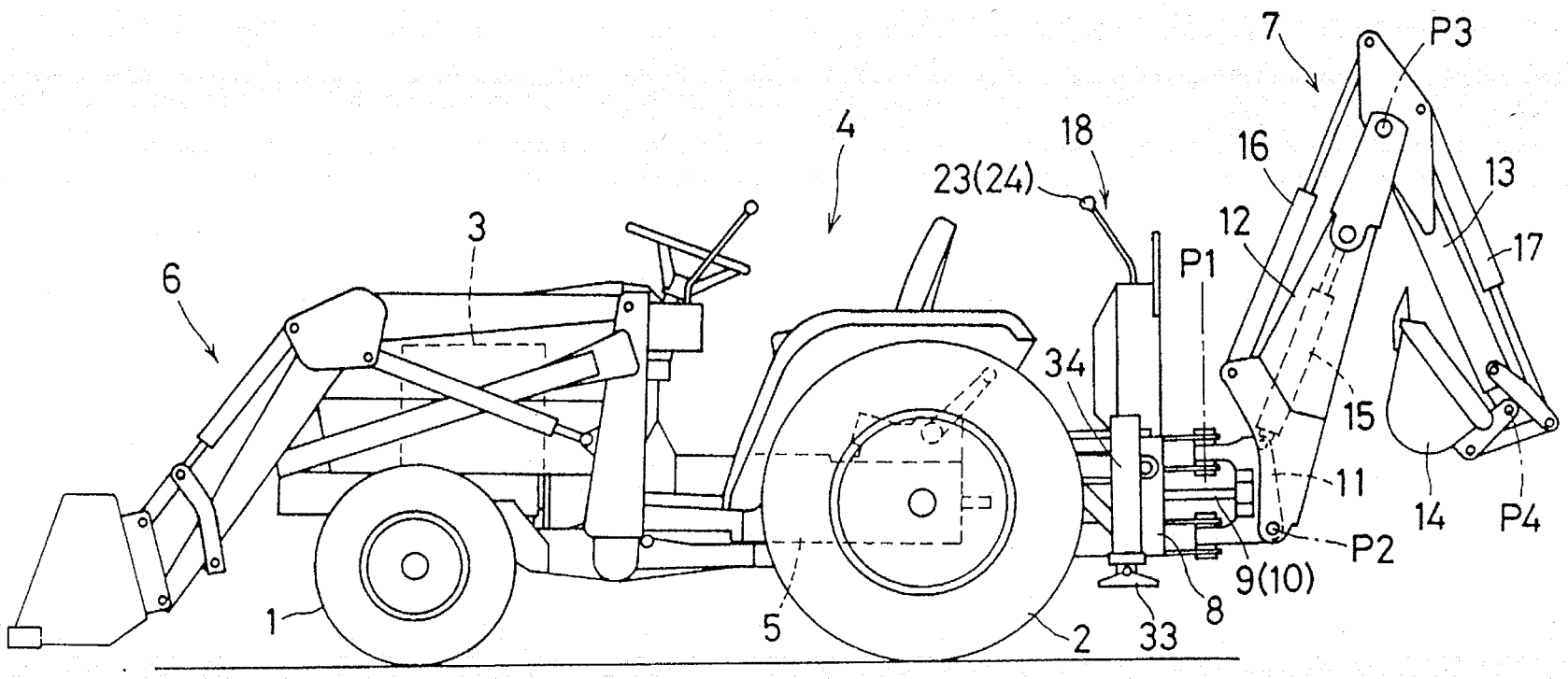
FIG. 1 is a side elevation of a tractor with a dozer implement and a backhoe implement attached thereto, and having a hydraulic control system according to the present invention.

As shown in FIG. 1, a tractor, which is one example of working vehicles, includes a pair of front wheels 1 and a pair of rear wheels 2 supporting a tractor body. The tractor body includes an engine 3 disposed in a front position, a driver's section 4 disposed in a middle position, and a transmission case 5 disposed in a rear position thereof. A dozer implement 6 is attached to the front of the tractor, and a backhoe implement 7 attached to the rear of the tractor.

The backhoe implement 7 will be described next.

As shown in FIG. 1, the backhoe implement 7 includes a support 8 connected rearwardly of the transmission case 8. The support 8 supports a swing bracket 11 swingable left and right about a vertical axis P1 by a pair of left and right hydraulic cylinder 9 and 10 (corresponding to hydraulic actuators). The swing bracket 11 supports a boom 12 pivotable about a horizontal axis P2 by a hydraulic cylinder 15. The boom 12 supports an ann 13 pivotable about a horizontal axis P3 at an extreme end of the boom 12 by a hydraulic cylinder 16. The ann 13 supports a bucket 14 pivotable about a horizontal axis P4 at an extreme end of the arm 13 by a hydraulic cylinder 17. The backhoe implement 7 further includes a pair of left and right outriggers 33 vertically movable by hydraulic cylinders 34, and a control section 18 fixed to the support 8.

A hydraulic control system for controlling the backhoe implement 7 will be described next.

Figure 2:
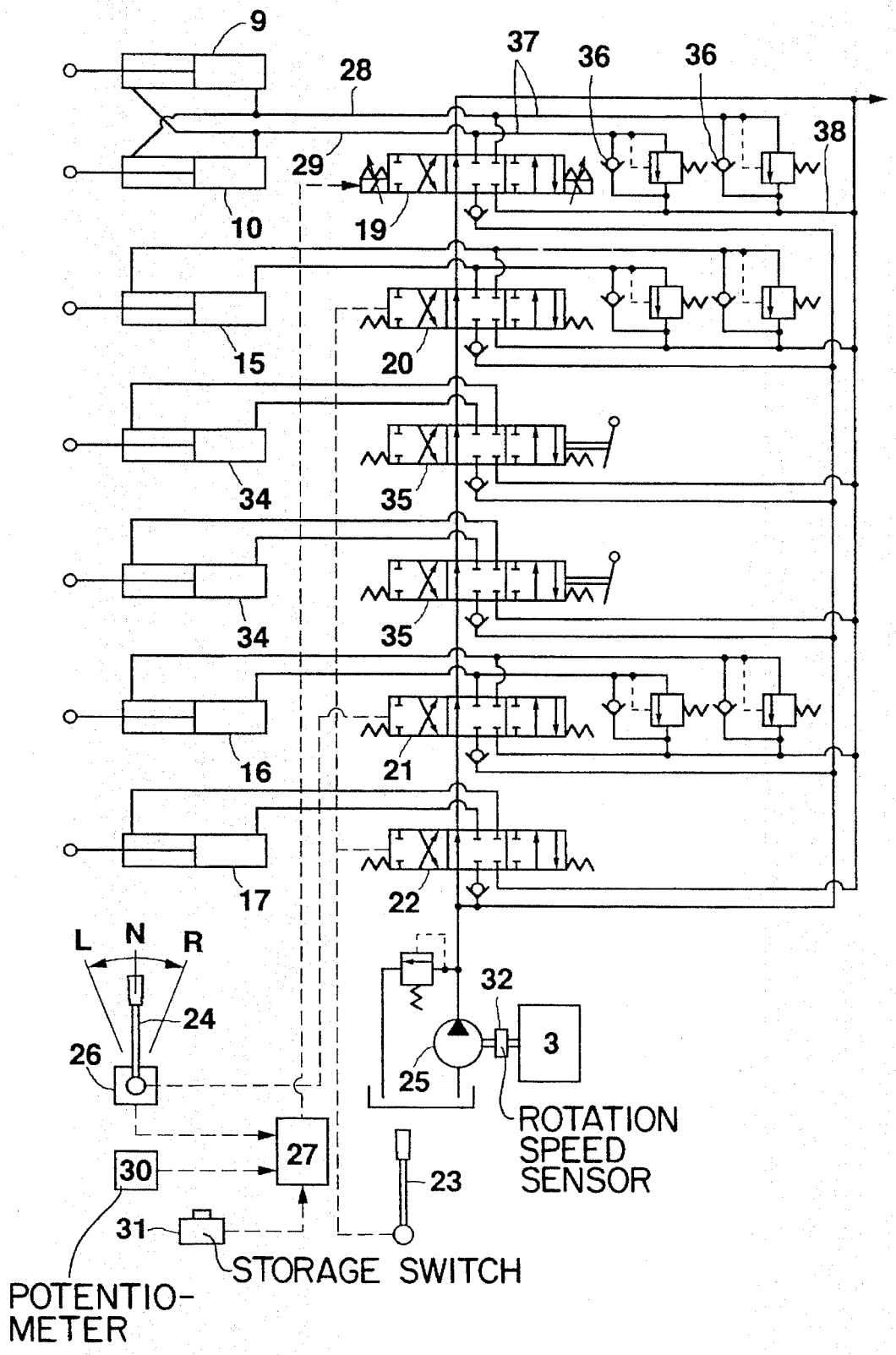
FIG. 2 is a diagram of hydraulic circuitry for controlling the backhoe implement.

As shown in FIG. 2, this control system includes an electromagnetic proportional control valve 19 for controlling flow rates of pressure oil to the pair of hydraulic cylinder 9 and 10 to control the swing bracket 11, a control valve 20 connected to the hydraulic cylinder 15 to control the boom 12, a pair of control valves 35 connected to the hydraulic cylinders 34 to control the outriggers 33, a control valve 21 connected to the hydraulic cylinder 16 to control the arm 13, and a control valve 22 connected to the hydraulic cylinder 17 to control the bucket 14. The electromagnetic proportional control valve 19 is a center bypass, neutral restoring type valve. Further, the electromagnetic proportional control valve 19 has an opening amount adjustable by a pulse signal acting as a control signal having varied duty ratios. The control valves 20, 21, 22 and 35 are center bypass type, mechanically operated valves. The electromagnetic proportional control valve 19 and control valves 20, 21, 22 and 35 are connected in parallel to one another to a pump 25.

As shown in FIGS. 1 and 2, the control section 18 of the backhoe implement 7 includes a right control lever 23 and a left control lever 24 (corresponding to the control device) operable fore and aft and left and right. The right control lever 23 is mechanically interlocked to the control valve 20 for controlling the boom 12, and to the control valve 20 for controlling the bucket 14. When the right control lever 23 is operated fore and aft, the control valve 20 is switched to swing the boom 12. When the right control lever 23 is operated left and right, the control valve 22 is switched to swing the bucket 14. The left control lever 24 is mechanically interlocked to the control valve 21 for controlling the arm 13. When the left control lever 24 is operated fore and aft, the control valve 21 is switched to swing the arm 13. A position sensor 26 is provided to detect left and right control positions of the left control lever 24. The position sensor 26 outputs detection values to be inputted to a control unit 27.

Figure 3:
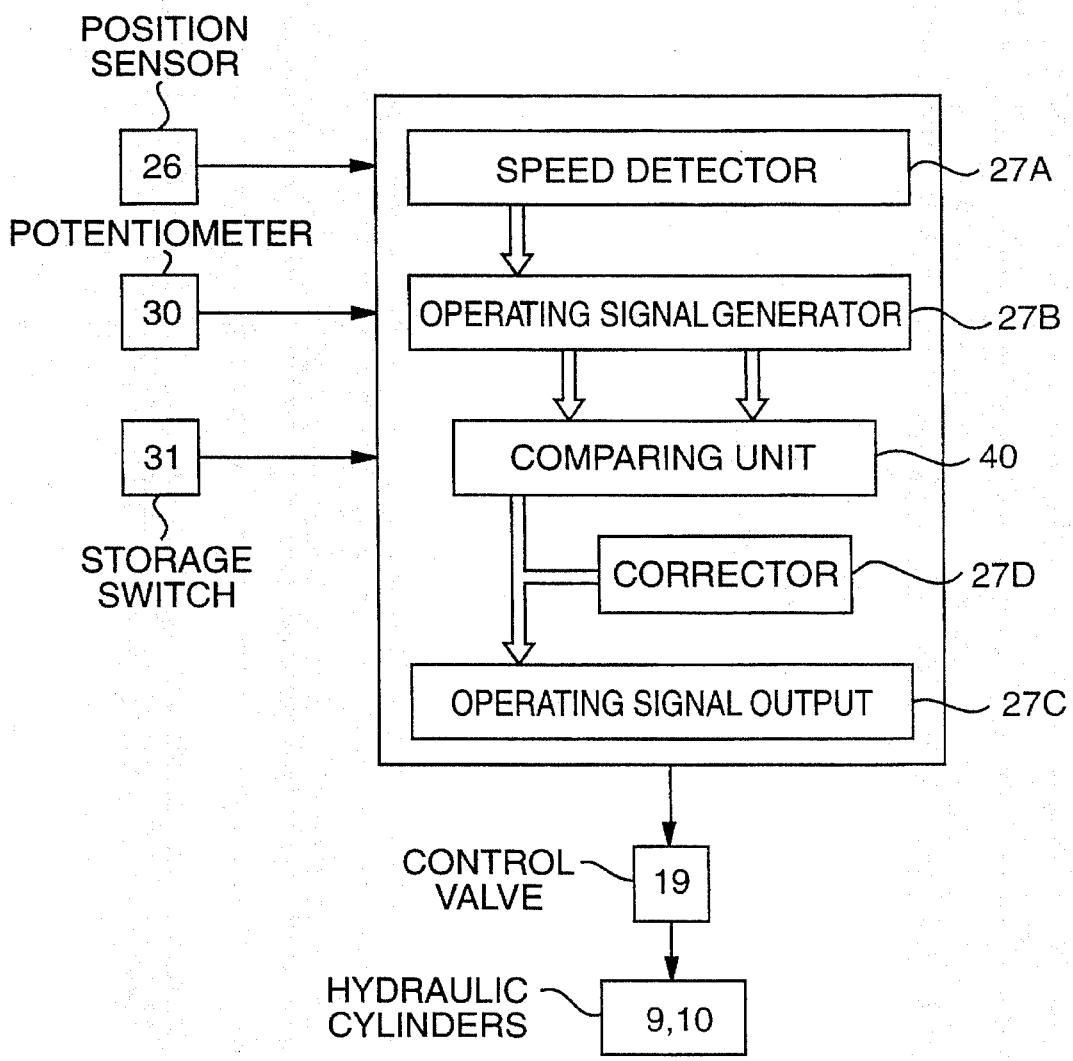
FIG. 3 is a block diagram of a control unit.

As shown in FIG. 3, the control unit 27 includes a speed detector 27A, an operating signal generator 27B, an operating signal output 27C and a corrector 27D. The speed detector 27A computes a shifting speed of the control lever 24 based on a detection value provided by the position sensor 25. The operating signal generator 27B generates an operating signal or control current for controlling the electromagnetic proportional control valve 19. The operating signal output 27C transmits the control current to the electromagnetic proportional control valve 19. The corrector 27D corrects the control current as necessary.

When the left control lever 24 is operated left or right, the control unit 27 outputs to the electromagnetic proportional control valve 19 a control current acting as a pulse signal having a duty ratio corresponding to a value computed in the control unit 27. The electromagnetic proportional control valve 19 is thereby operated to swing the swing bracket 11 left or right. For expediency of description, this pulse signal acting as the operating signal is regarded as the control current hereinafter.

Operation of the swing bracket 11 of the backhoe implement 7 will be described next.

Figure 4A:
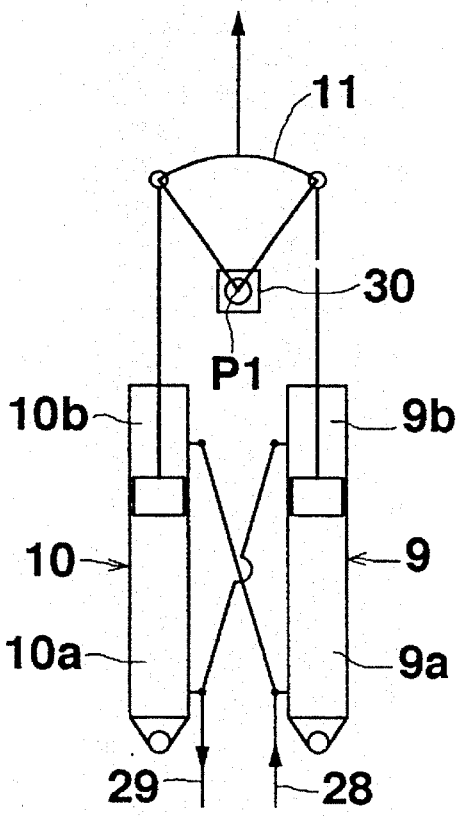
FIGS. 4A, 4B and 4C are schematic views showing different positions of a swing bracket and hydraulic cylinders of the backhoe implement.

As shown in FIGS. 4A and 1, the swing bracket 11 is supported to be swingable left and right about the vertical axis P1 of the support 8 of the backhoe implement 7. The pair of left and right hydraulic cylinders 9 and 10 of the double acting type are opposed to each other across the vertical axis P1 and connected to the swing bracket 11.

As shown in FIGS. 4A and 2, a pair of oil lines 28 and 29 extend from the electromagnetic proportional control valve 19. One of the oil lines 28 is connected in parallel to an oil chamber 9*a* for extending one of the hydraulic cylinders 9 and to an oil chamber 10*b* for contracting the other hydraulic cylinder 10. The other oil line 29 is connected in parallel to an oil chamber 9*b* for contracting one of the hydraulic cylinders 9 and to an oil chamber 10*a* for extending the other hydraulic cylinder 10.

FIG. 4A shows the swing bracket 11 lying in a transversely middle position. When, in this position, pressure oil is supplied from the electromagnetic proportional control valve 19 to the oil line 28, for example, one of the hydraulic cylinders 9 begins to extend, and the other hydraulic cylinder 10 begins to contract, whereby the swing bracket 11 begins to swing leftward.

Figure 4B:
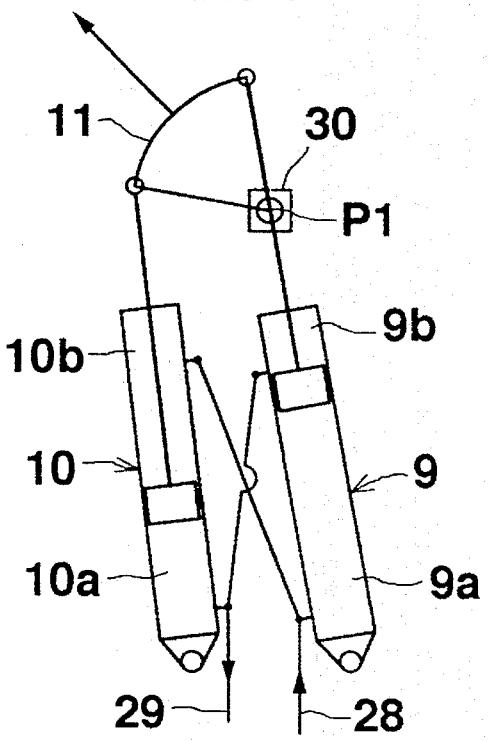
Figure 4C:
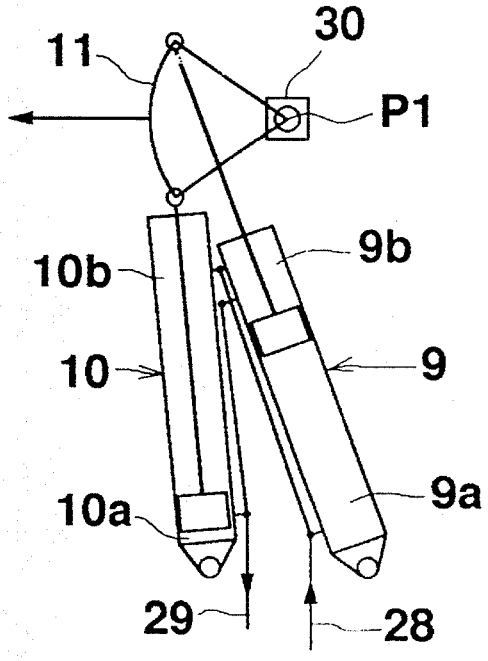

When one of the hydraulic cylinders 9 reaches the vertical axis P1 as shown in FIG. 4B, the hydraulic cylinder 9 is extended near a stroke end. Then, the pressure oil drained from the extension-side oil chamber 10a of the other hydraulic cylinder 10 as a result of contraction thereof is supplied to the contraction-side oil chamber 9*b* of the hydraulic cylinder 9. Consequently, the hydraulic cylinder 9 is also contracted, whereby the swing bracket 11 reaches a leftward limit of its swinging range as shown in FIG. 4C.

A similar situation occurs when swinging the swing bracket 11 rightward.

Operation of the left control lever 24 to control the hydraulic cylinders 9 and 10 of the swing bracket 11 will be described next.

Based on left and right shift positions of the left control lever 24 (detection values of the position sensor 26), the control unit 27 supplies control currents to the electromagnetic proportional control valve 19 so that moving speeds of the swing bracket 11 correspond to the shift positions of the left control lever 24. Thus, opening amounts of the electromagnetic proportional control valve 19 correspond to the shift positions of the left control lever 24.

With this setting, when the left control lever 24 is operated to a neutral stop position N, the control current for the electromagnetic proportional control valve 19 becomes zero. Then, the proportional control valve 19 moves to a neutral position by its own neutral restoring function. The hydraulic cylinders 9 and 10 stop as a result.

Next, as the left control lever 24 is operated from the neutral stop position N toward a right shift position R or a left shift position L, the control unit 27 outputs a progressively increasing control current to the electromagnetic proportional control valve 19 to open the control valve 19 to a greater degree. Thus, the greater the amount of operation of the left control lever 24, the higher is the flow rate of pressure oil from the electromagnetic proportional control valve 19. At this time, a shifting velocity of the control lever 24 is also used as a control parameter.

Figure 5A:
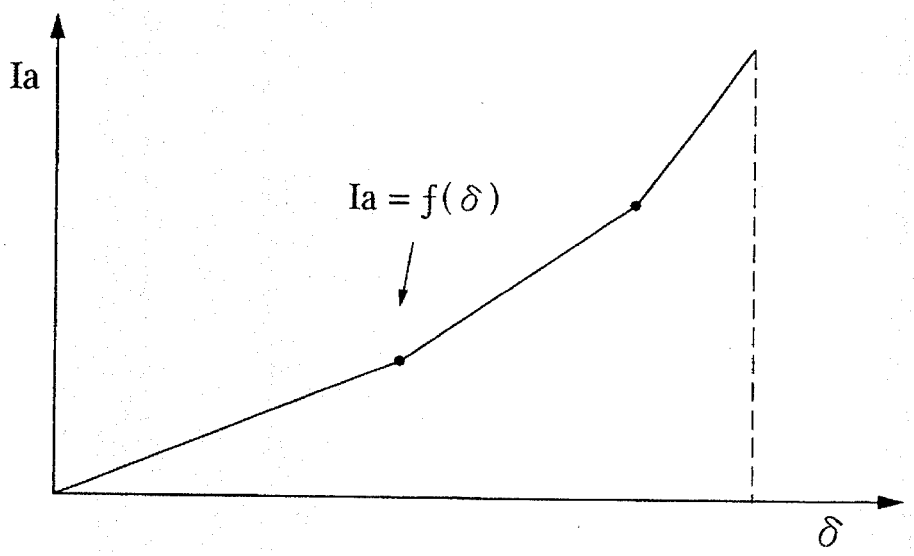
FIG. 5A is a view showing a relationship between control currents applied to an electromagnetic proportional control valve and shift positions of a left control lever after the left control lever begins to shift from a neutral stop position.

FIG. 5A shows a relationship: Ia=f between amount of operation: δ of the left control lever 24 and control current: Ia applied to the electromagnetic proportional control valve 19. Control current: Ia is expressed as the linear function of δ, and its linear equation has different gradients for three regions of amount of operation: δ. The relationship of control current: Ia to the amount of operation: δ may of course be a square or other function.

Figure 5B:
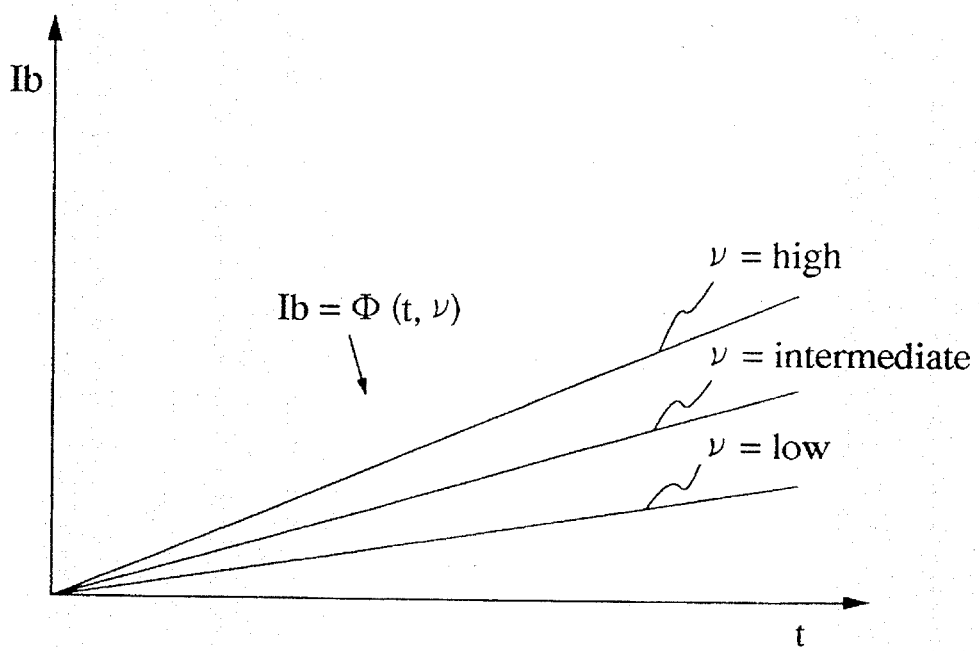
FIG. 5B is a view showing a relationship among control currents applied to the electromagnetic proportional control valve, shift positions of the left control lever and lapse of time after the left control lever begins to shift from the neutral stop position.

FIG. 5B shows a relationship between lapse of time t after shifting the left control lever 24 from the neutral stop position N and control current: Ib applied to the electromagnetic proportional control valve 19. This relationship also includes shifting velocity: v of the left control lever 24 as a parameter, and its function is expressed as Ib=ϕ(t, v). The shifting velocity: v is divided into three stages, i.e. high speed, intermediate speed and low speed. The three functions, Ib=ϕ(t, high speed), Ib=ϕ (t, intermediate speed) and Ib=ϕ (t, low speed), are shown as linear functions, but may be other functions. These functions are stored in the form of a table in the control unit 27. The speed detector 27A in the control unit 27 computes the shifting velocity of the left control lever 24 from the detection value provided by the position sensor 26.

When the left control lever 24 is operated from the neutral stop position N toward the right shift position R or left shift position L, the operating signal generator 27B determines a corresponding Ia from the relationship: f(δ) between amount of operation: δ of the left control lever 24 and control current: Ia to be applied to the electromagnetic proportional control valve 19 as shown in FIG. 5A, and a corresponding Ib (=ϕ(t, v)) from the relationship between lapse of time t after shifting the left control lever 24 from the neutral stop position N and control current: Ib to be applied to the electromagnetic proportional control valve 19. The smaller of the two values Ia and Ib is selected as the control current by a comparing unit 40 and applied to the electromagnetic proportional control valve 19 through the operating signal output 27C.

Consequently, control current: Ib based on the relationship shown in FIG. 5B is employed for a time the left control lever 24 is operated from the neutral stop position N toward the right shift position R or left shift position L. Thus, the electromagnetic proportional control valve 19 receives a control current corresponding to a shifting velocity of the control lever 24. After lapse of that time, the value of Ib increases, and control current Ia shown in FIG. 5A is employed.

For slightly moving the swing bracket 11, for example, the left control lever 24 is operated slowly from the neutral stop position N. As a result, the corresponding cylinder 9 or 10 receives a small quantity of oil for the amount of operation of the control lever 24. This enables the swing bracket 11 to be set to a selected position accurately. That is, when the left control lever 24 is operated slowly, it takes a little while before the control current outputted from the control unit 27 reaches a value corresponding to an amount of operation of the control lever 24.

Reverting to FIG. 2, the electromagnetic proportional control valve 19 has an exhaust oil line 38 connected through oil lines 37 having check valves 36 to the oil lines 28 and 29 extending to the hydraulic cylinders 9 and 10, respectively. With this construction, pressure oil is supplemented from the exhaust oil line 38 through the oil lines 37 to the oil lines 28 and 29, as necessary, to avoid cavitation.

The swing bracket 11 is swung by the two hydraulic cylinders 9 and 10. When the swing bracket 11 lies between the positions shown in FIGS. 4B and 4C, the two hydraulic cylinders 9 and 10 are extended or contracted in the same direction to swing the swing bracket 11. When the swing bracket 11 lies between the positions shown in FIGS. 4A and 4B, the two hydraulic cylinders 9 and 10 are extended or contracted in opposite directions to swing the swing bracket 11.

When starting to swing the swing bracket 11 standing still between the positions shown in FIGS. 4B and 4C, one of the hydraulic cylinders 9 and 10 has a higher pressure than the other. Once the swing bracket 11 is in swinging motion, a desired speed is achieved with a relatively low flow rate of pressure oil.

When one of the hydraulic cylinders 9 and 10 lies on the vertical axis P1 as shown in FIG. 4B, this hydraulic cylinder does not take part in the operation to swing the swing bracket 11. At this time, only the other hydraulic cylinder 9 or 10 swings the swing bracket 11. As a result, the swinging speed of the swing bracket 11 could become slightly lower than the swinging speed corresponding to the shift position of the left control lever 24.

As a countermeasure to this inconvenience, the control unit 27 in this embodiment includes the corrector 27D for correcting the control current determined by the operating signal generator 27B.

As shown in FIGS. 4A and 2, a potentiometer 30 is disposed on the vertical axis P1 of the swing bracket 11 for detecting positions of the swing bracket 11. The corrector 27D is operable to establish the relationships shown in FIG. 5 for the flow rates through the oil lines 28 and 29 in response to positions of the swing bracket 11 swingable through a 0 to 180 degree range. In this case, the flow rate through the oil line 28 or 29 reaches a maximum value when the swing bracket 11 is in the position shown in FIG. 4B or in a position symmetrical thereto.

Thus, when the left control lever 24 is operated the same amount from the neutral stop position N, the swing bracket 11 is swung at a constant speed from whichever position in the 0 to 180 degree range.

Figure 6:
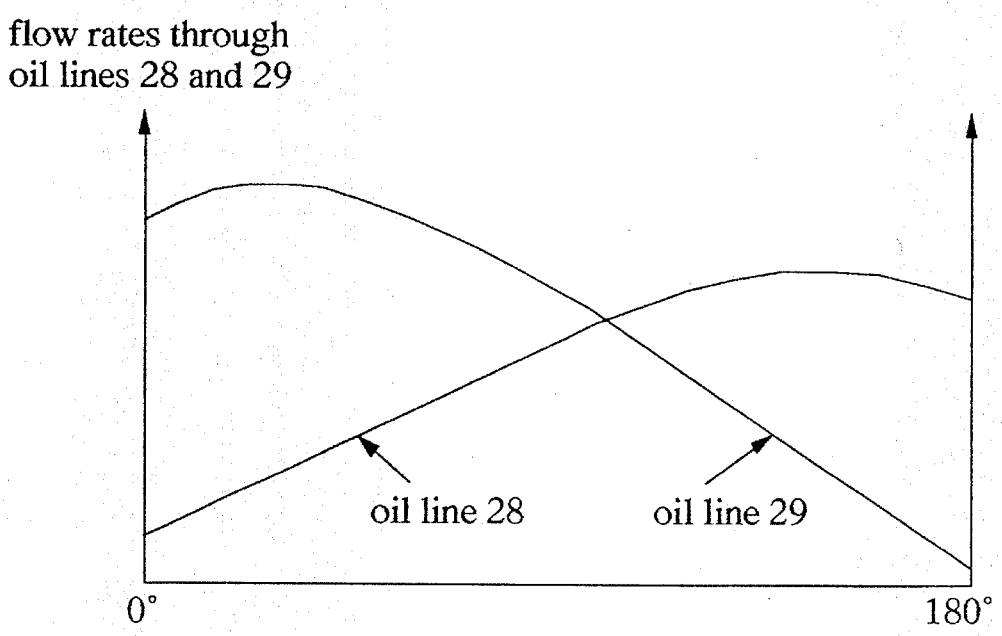
FIG. 6 is a view showing a relationship between positions of the swing bracket and flow rates of pressure oil to the hydraulic cylinders.

When varying the speed of the swing bracket 11 based on a left or right shift position of the left control lever 24 as described hereinbefore, solid lines in Fig. 6 are shifted in a flow rate increasing or decreasing direction while maintaining the relationship shown in the solid lines. Consequently, the swing bracket 11 is swung from whichever position in the 0 to 180 degree range, at a speed corresponding to a shift position of the left control lever 24.

Figure 7:
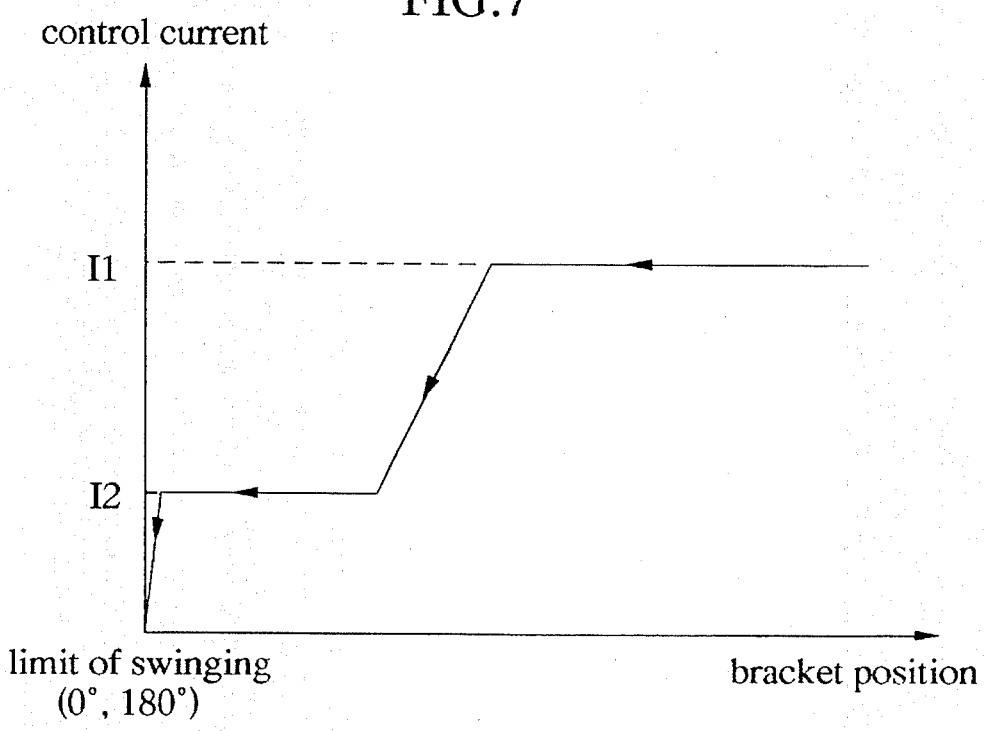
FIG. 7 is a view showing a control current occurring when the swing bracket reaches a left or right limit of a swinging range.

In swinging the swing bracket 11 by operating the left control lever 24, the electromagnetic proportional control valve 19 may be controlled with a characteristic as shown in FIG. 7, to stop the swing bracket 11 at a left or right limit (a 0 or 180 degree position).

Assume that, as shown in FIG. 7, the swing bracket 11 approaches the left or right limit, with the electromagnetic proportional control valve 19 supplied with control current I1 corresponding to a shift position of the left control lever 24. When the swing bracket 11 reaches a predetermined distance to the left or right limit, control current I1 is decreased linearly regardless of the operation of the left control lever 24. When a change has been made from control current I1 to control current I2, the latter is maintained. When the swing bracket 11 reaches the limit, control current I2 falls to zero.

In the characteristic shown in FIG. 7, if an initial shift position (corresponding to control current I1) of the left control lever 24 is a high speed position (close to the right or left position R or L), the solid line and maintained control current I2 in FIG. 7 are as a whole shifted in a low current direction. If the initial shift position (corresponding to control current I1) of the left control lever 24 is a low speed position (close to the neutral stop position N), the solid line and maintained control current I2 in FIG. 7 are as a whole shifted in a high current direction.

As shown in FIG. 2, a sensor 32 is provided for detecting a rotating rate of the engine 3. When the engine 3 rotates at a high rate, the maintained control current I2 in FIG. 7 is shifted in the low current direction. When the engine 3 rotates at a low rate, the maintained control current I2 in FIG. 7 is shifted in the high current direction.

When the swing bracket 11 is stopped at a position between the right and left limits by rapidly returning the left control lever 24 to the neutral stop position N, the electromagnetic proportional control valve 19 is operated back in an opening direction for an instant as the swing bracket 11 stops. This is effective to avoid a pressure lock in the hydraulic cylinders 9 and 10 and lighten a shock occurring with stoppage of the swing bracket 11.

When the electromagnetic proportional control valve 19 is rapidly returned to the neutral position, pressure oil is supplemented from the exhaust oil line 38 through the oil line 37 to the oil line 28 or 29 to prevent a negative pressure from being generated in the pushing hydraulic cylinder 9 or 10 (the right hydraulic cylinder 9 when the swing bracket 11 is swung left). This avoids instability of the swing bracket 11 after stoppage.

In swinging the swing bracket 11, the control unit 27 may store a stopping position as a target position of the swing bracket 11, and automatically stop the swing bracket 11 at the target position. A sequence of this automatic stopping control will be described next.

Figure 8:
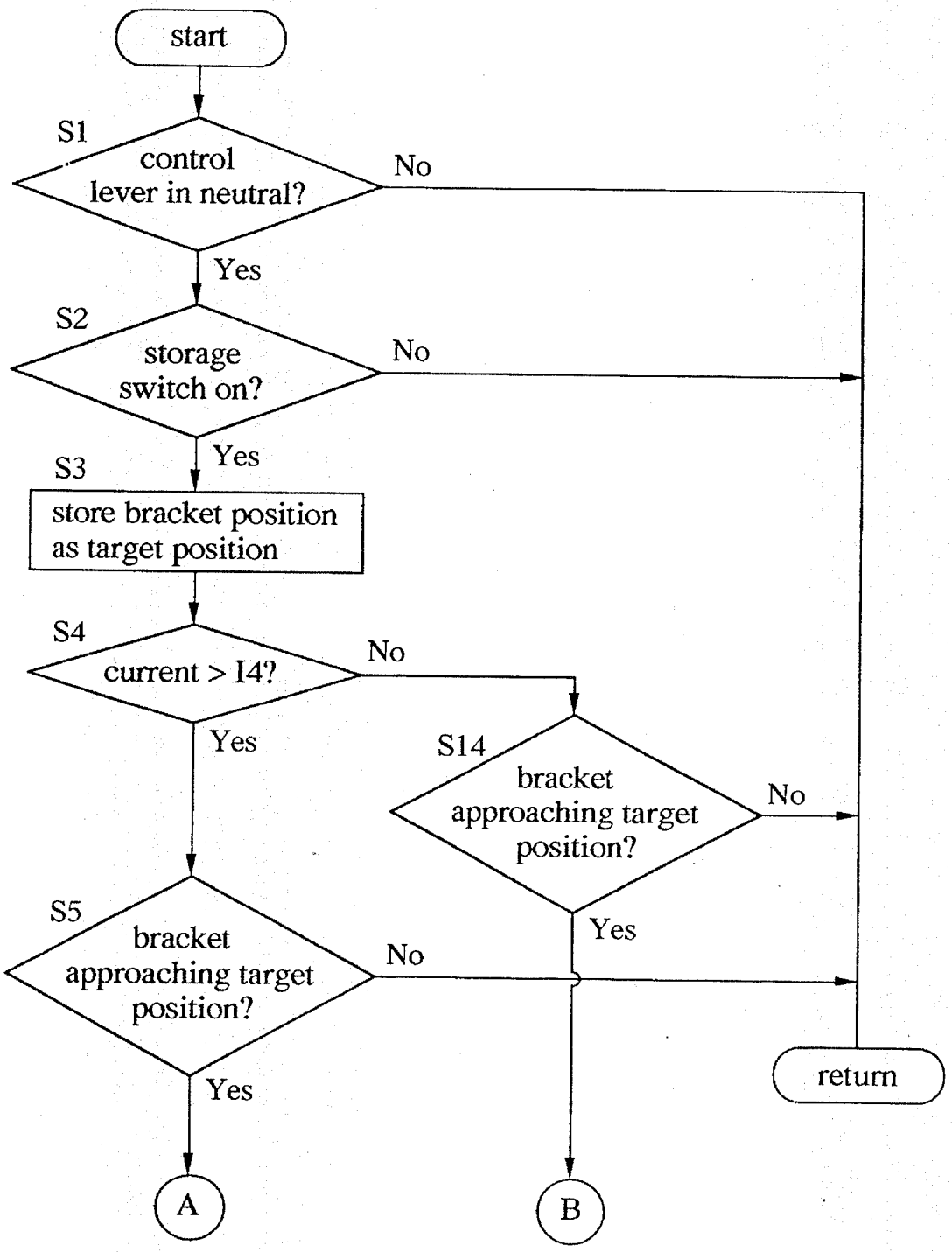
FIG. 8 is a flowchart showing a first half of a control sequence for automatically stopping the swing bracket at a target position stored in memory.
Figure 9:
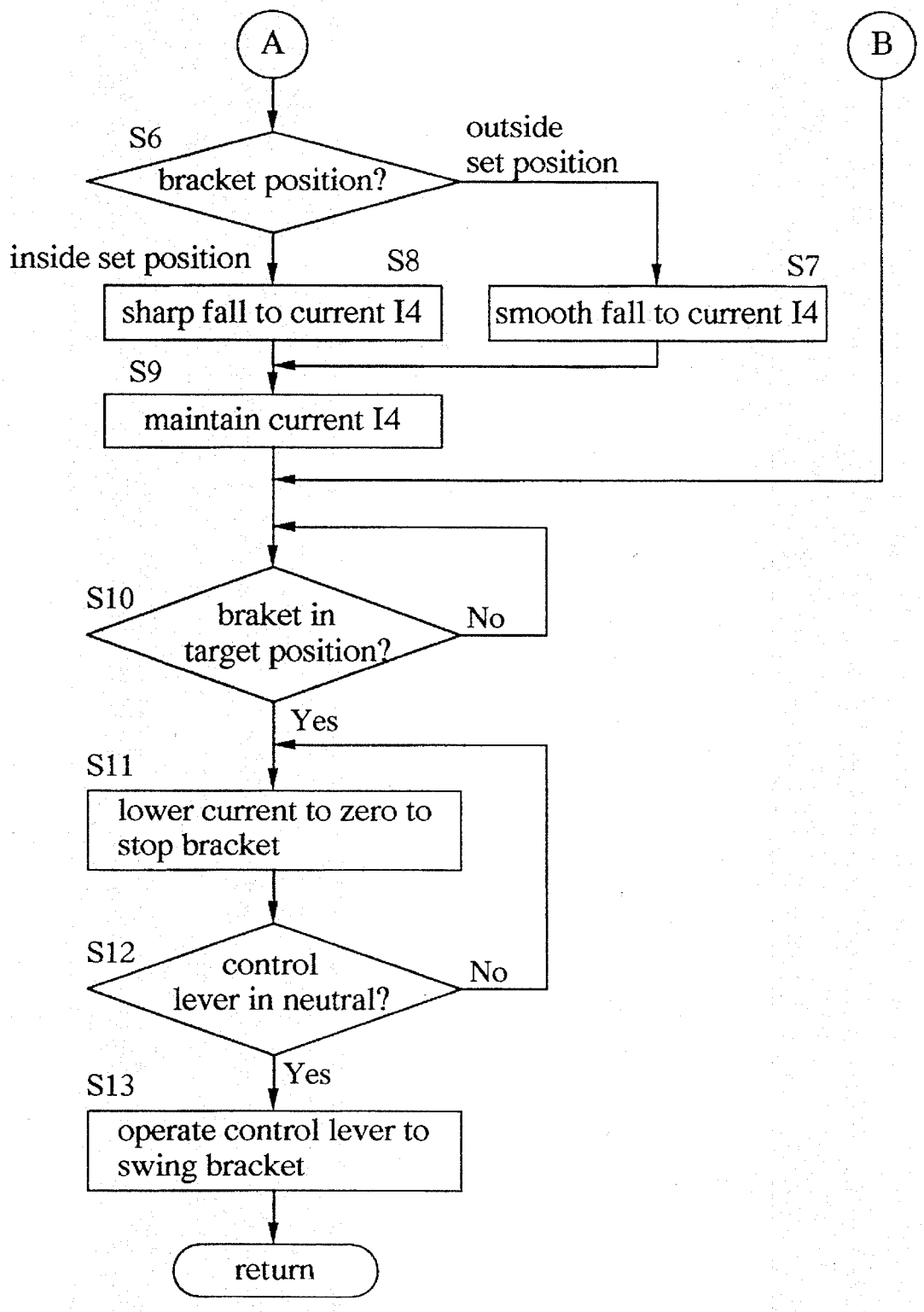
FIG. 9 is a flowchart showing a second half of the control sequence for automatically stopping the swing bracket at the target position stored in memory.

Referring to FIGS. 8 and 9, the left control lever 24 is operated to swing the swing bracket 11 to a desired position and then the left control lever 24 is returned to the neutral stop position N (step S1). In this state, a storage switch 31 as shown in FIG. 2 is pressed (step S2). Based on a detection value provided by the potentiometer 30, this position of the swing bracket 11 is stored as a target position (step S3).

Figure 10:
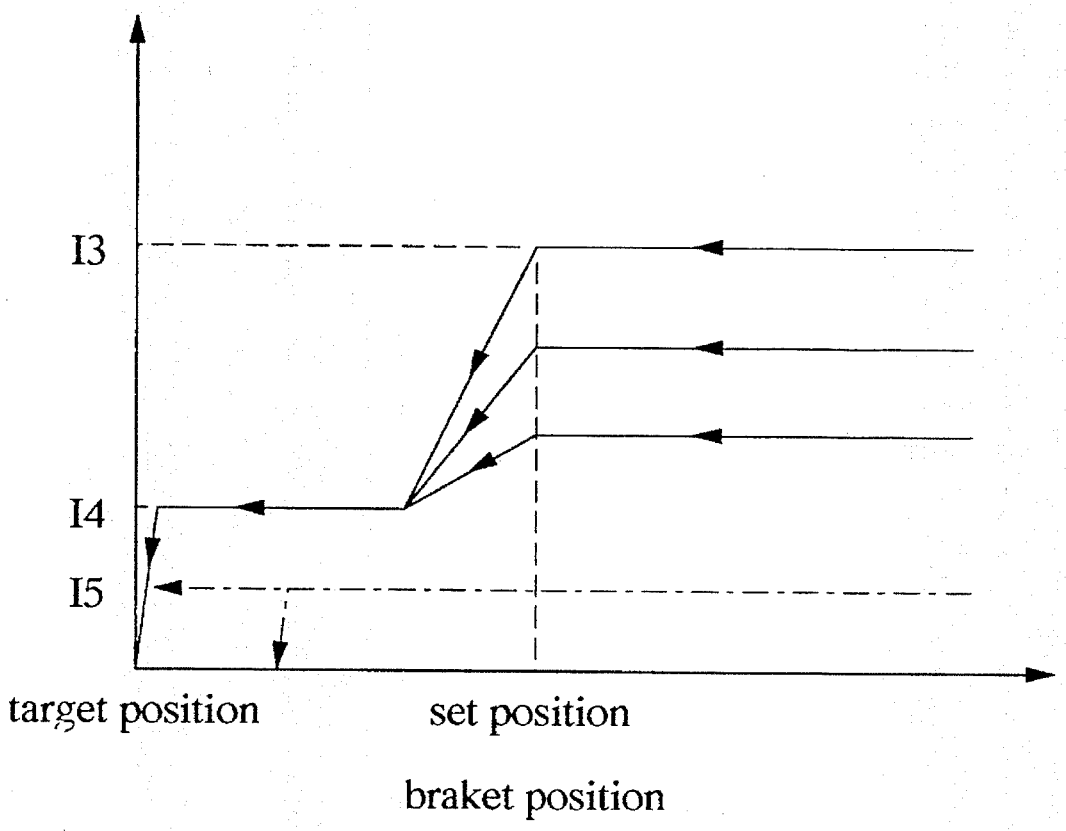
FIG. 10 is a view showing control currents applied to the electromagnetic proportional control valve for automatically stopping the swing bracket at the target position stored in memory.

Next, the left control lever 24 is shifted to a position corresponding to control current 13, as shown in a solid line in FIG. 10, which is higher than a predetermined control current 14 to be supplied to the electromagnetic proportional control valve 19 (step S4). If the swing bracket 11 is swung toward the target position stored (step S5), a position from which the swing bracket 11 is swung is checked against a set position having a predetermined distance to the target position (step S6). If the swing starting position is outside the set position, the control current I3 is lowered linearly or smoothly to the predetermined control current I4 (step S7).

Conversely, if the swing starting position is inside the set position, the control current 13 is lowered sharply to the predetermined control current I4 (step S8).

Thus, the control current supplied to the electromagnetic proportional control valve 19 is lowered to control current I4, thereby to decelerate movement of the swing bracket 11. This control current I4 is maintained (step S9). When the swing bracket 11 reaches the target position stored (step S10), the control current for the electromagnetic proportional control valve 19 is lowered to zero, whereby the swing bracket 11 automatically stops at the target position (step S11).

If the left control lever 24 is returned to the neutral stop position N after the swing bracket 11 has stopped at the target position (step S12), the swing bracket 11 is reinstated in the original state swingable by operation of the left control lever 24 (step S13).

If the left control lever 24 is returned to the neutral stop position N before the swing bracket 11 reaches the target position, the swing bracket 11 stops short of the target position. Then, the swing bracket 11 may be swung away from the target position by shifting the left control lever 24 in the opposite direction.

Assume that, at step S4, the left control lever 24 is shifted to a position corresponding to control current 15, as shown in the dot-and-dash line in FIG. 10, which is lower than the predetermined control current 14. Even if the swing bracket 11 is swung toward the target position stored in this state, the above deceleration does not take place (step S14). The swing bracket 11 continues to swing with the low control current I5. When the swing bracket 11 reaches the target position (step S10), the swing bracket 11 automatically stops at the target position (step S11).

If the left control lever 24 is returned to the neutral stop position N while the swing bracket 11 is swinging with the low control current I5, the swing bracket 11 stops short of the target position. Then, the swing bracket 11 may be swung away from the target position by shifting the left control lever 24 in the opposite direction.

When automatically stopping the swing bracket 11 at the target position with the characteristics shown in the solid lines in FIG. 10, the hydraulic cylinders 9 and 10 are in varied states in each position in the 0 to 180 degree swinging range of the swing bracket 11 as described hereinbefore.

Thus, the 0 to 180 degree swinging range of the swing bracket 11 is divided into a plurality of regions, and the region including the target position stored is determined. If the target position lies in the region adjacent the 90 degree position, the predetermined control current I4 shown in the solid line in FIG. 10 is slightly raised. Conversely, if the target position lies in the region adjacent one of the limits of the swinging range (0 or 180 degree position), the predetermined control current I4 is slightly lowered.

The foregoing embodiment uses the electromagnetic proportional control valve 19 for controlling the hydraulic cylinders 9 and 10. Alternatively, a pilot-operated flow control valve may be used.

The hydraulic control system described in the above embodiment is applicable not only to the swing bracket 11 of the backhoe implement 7, but to the boom 12, arm 13 or other component of the backhoe implement 7. Further, this control system is not limited in application to the backhoe implement 7, but may be applied to the dozer implement 6 or other working implement also.

What is claimed is:

1. A control system for controlling a flow control valve to drive a hydraulic actuator in response to operation of a control device, comprising:

position detecting means for detecting a shift position of said control device;

speed detecting means for detecting a shifting speed of said control device;

control signal generating means for generating a control signal to control said flow control valve based on said shift position and said shifting speed of said control device; and control signal output means for outputting said control signal to said flow control valve; wherein said control signal generating means includes a first signal computing unit for determining a first control signal value based on a shift of said control device, a second control signal computing unit for determining a second control signal value based on lapse of time from start of the shift of said control device and said shifting speed of said control device, and a comparing unit for comparing said first control signal value and said second control signal value and selecting a value providing a smaller opening amount of said flow control valve to act as said control signal.

2. A control system as defined in claim 1, wherein said first control signal computing unit is operable to determine said first control signal value as a function of a shift of said control current, said first control signal value having a lower rate of change for a small shift zone than for a large shift zone.

3. A control system as defined in claim 1, wherein said second control signal computing unit is operable to recognize said shifting speed as one of a high speed, an intermediate speed and a low speed, said second control signal value being a function of a lapse of time from start of a shift of said control device for each of said high speed, said intermediate speed and said low speed.

* * * * *